US005551277A

United States Patent [19]

Anthony et al.

[11] Patent Number: 5,551,277

[45] Date of Patent: Sep. 3, 1996

[54] ANNULAR DIAMOND BODIES

[75] Inventors: Thomas R. Anthony, Niskayuna, N.Y.; Friedel S. Knemeyer, Granville; Bradley E. Williams, Worthington, both of Ohio

[73] Assignee: General Electric Company, Worthington, Ohio

[21] Appl. No.: 311,658

[22] Filed: Sep. 23, 1994

[51] Int. Cl.[6] ..... B21C 3/02

[52] U.S. Cl. ..... 72/467

[58] Field of Search ..... 72/467; 423/446

[56] References Cited

U.S. PATENT DOCUMENTS

| | | | |
|---|---|---|---|
| 4,707,384 | 11/1987 | Schachner et al. | 428/408 |
| 5,110,579 | 5/1992 | Anthony | 423/446 |
| 5,130,111 | 7/1992 | Pryor | 423/446 |
| 5,173,089 | 12/1992 | Tanabe | 51/293 |
| 5,387,447 | 2/1995 | Slutz | 72/462 |

FOREIGN PATENT DOCUMENTS

| | | | |
|---|---|---|---|
| 0437830A1 | 7/1991 | European Pat. Off. . | |
| 0442303A1 | 8/1991 | European Pat. Off. . | |
| 467634A2 | 1/1992 | European Pat. Off. . | |
| 584833 | 3/1994 | European Pat. Off. | 72/467 |
| 62-296707 | 5/1989 | Japan . | |

OTHER PUBLICATIONS

Emerging Technology of Diamond Thin Films/Chemical & Engineering News, Vo. 67, NI. 20, pp. 24–39, 1989.

*Primary Examiner*—Daniel C. Crane

[57] ABSTRACT

An annular body, which may be a die for drawing wire, comprises an annular transparent CVD diamond body having an opening of uniform diameter with an interior surface in a region of smaller diamond grains and an external surface in a region of larger diamond grains.

29 Claims, 1 Drawing Sheet

ANNULAR DIAMOND BODIES

TECHNICAL FIELD OF THE INVENTION

The present invention relates to annular shapes of diamond which have utility as wire dies.

BACKGROUND OF THE INVENTION

Wires of metals such as tungsten, copper, iron, molybdenum, and stainless steel are produced by drawing the metals through diamond dies. Single crystal diamond dies are difficult to fabricate, tend to chip easily, easily cleave, and often fail catastrophically because of the extreme pressures involved during wire drawing.

With reference to single crystal wire dies, it is reported in Properties and Applications of Diamond, Wilks et al, Butterworth-Heinemann Ltd 1991, pages 505–507: "The best choice of [crystallographic] direction is not too obvious because as the wire passes through the die its circumference is abrading the diamond on a whole 360° range of planes, and the rates of wear on these planes will be somewhat different. Hence, the originally circular hole will not only grow larger but will loose its shape. However, <110> directions offer the advantage that the wire is abrading the sides of the hole with {001} and {011} orientations in abrasion resistant directions."

Diamond dies which avoid some of the problems attendant with natural diamonds of poorer quality comprise microporous masses compacted from tiny crystals of natural or synthesized diamonds or from crystals of diamond. The deficiencies of such polycrystalline hard masses, as indicated in U.S. Pat. No. 4,016,736, are due to the presence of micro-voids/pores and soft inclusions. These voids and inclusions can be more than 10 microns in diameter. The improvement of the patent utilizes a metal cemented carbide jacket as a source of flowable metal which fills the voids resulting in an improved wire die.

European Patent Application 0 494 799 A1 describes a polycrystalline CVD diamond layer having a hole formed therethrough and mounted in a support. As set forth in column 2, lines 26–30, "The relatively random distribution of crystal orientations in the CVD diamond ensures more even wear during use of the insert." As set forth in column 3, lines 50–54, The orientation of the diamond in the polycrystalline CVD diamond layer 10 may be such that most of the crystallites have a (111) crystallographic axis in the plane, i.e. parallel to the surfaces 14, 16, of the layer 10.

Other crystal orientations for CVD films are known. U.S. Pat. No. 5,110,579 to Anthony et al describes a transparent polycrystalline diamond film as illustrated in FIG. 3A, substantially transparent columns of diamond crystals having a <110> orientation perpendicular to the base.

Because of its high purity and uniform consistency, CVD diamond may be desirably used as compared to the more readily available and poor quality natural diamond. Because CVD diamond can be produced without attendant voids, it is often more desirable than polycrystalline diamond produced by high temperature and high pressure processes. However, further improvements in the structure of CVD wire drawing dies are desirable. Particularly, improvements in grain structure of CVD diamond wire die which tend to enhance wear and uniformity of wear are particularly desirable.

BRIEF SUMMARY OF THE INVENTION

Hence, it is desirable obtain a dense void-free CVD diamond wire die having a structure which provides for enhanced wear and uniformity of wear.

In accordance with the present invention, there is provided an annular transparent CVD diamond body having central opening of uniform diameter with an interior surface in a region of smaller diamond grains and an external surface in a region of larger diamond grains.

In accordance with preferred embodiments, the annular body is a wire die with the interior surface of the opening extending through said body and having a wire bearing portion of substantially circular cross-section determinative of the diameter of the wire.

In accordance with an additional preferred embodiment, a die for drawing wire has an opening extending entirely through the body along an axial direction from one surface to the other in an axial direction with diamond grains having a <110> orientation extending in a direction substantially normal to the axial direction.

DETAILED DESCRIPTION

Figure 1:
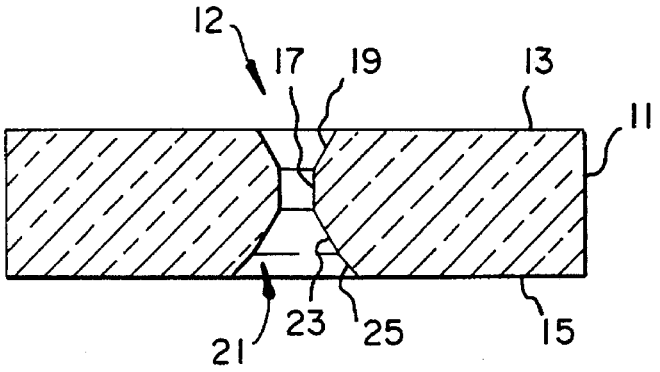
FIG. 1 is a cross-sectional view of a diamond wire die.
Figure 2:
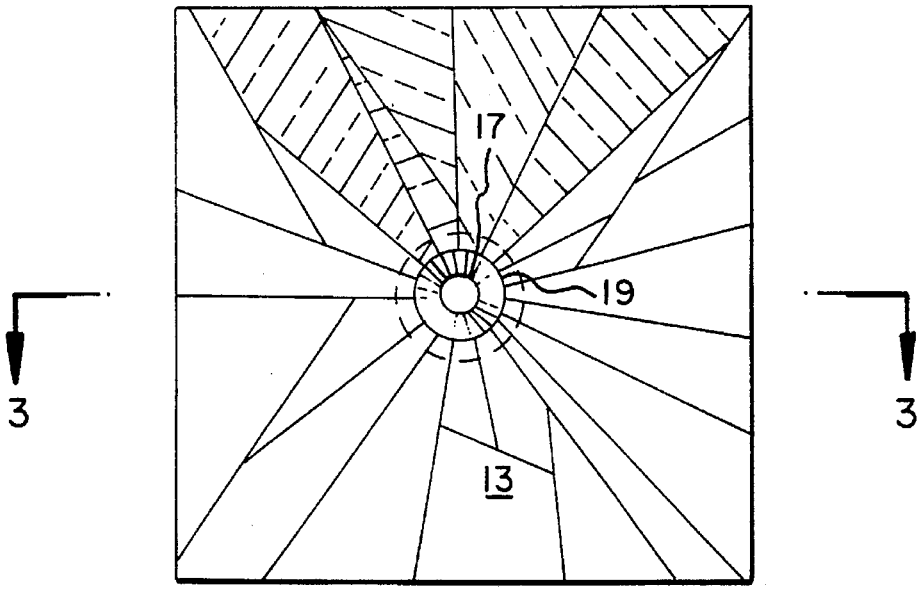
FIG. 2 is an enlarged top-view of a portion of the wire die shown in FIG. 1.

FIG. 1 illustrates a diamond wire die 11 produced from a CVD diamond tube or annular body. Typical apparatus for producing such an annular body is described in U.S. patent application Ser. No. 08/138,888 to Slutz entitled Method for Producing Uniform Cylindrical Tubes of CVD Diamond. The specification is incorporated by reference into the present application. According to the technique described therein, diamond tubes are produced by the chemical vapor deposition of diamond on a cylindrically shaped substrate from a suitable gaseous mixture being passed over a hot filament. The CVD reactor is configured to accept a plurality of substrates which are rotated so as to achieve a uniform deposition of diamond.

The substrate material is desirable stable at the elevated CVD diamond forming temperatures. Typical substrate materials include, for example, metals such as tungsten, molybdenum, silicon and platinum, alloys, ceramics such as silicon carbide, boron nitride, aluminum nitride. Also carbon such as graphite may be utilized. The preferred material is molybdenum.

As set forth in U.S. Ser. No. 08/138,888, the preferred substrate is cross sectional uniform in size and shape. Most preferably, the substrate is a cylinder such as a wire or tube. It is contemplated that substrates with square, rectangular, triangular, or other cross-sectional shape may be employed. The substrate is mounted in the CVD deposition chamber so that diamond is uniformly deposited on the substrate. According to the apparatus, the substrates are supported by a means which permits rotation along their axes parallel to the filament.

After the deposition process, the substrate which is surrounded by deposited diamond is removed to form an annular diamond body having an interior surface about a central opening and an exterior surface radially spaced from the interior surface. When the substrate is metal, it may be conveniently etched away by acid leaching.

After removal of the substrate, the diamond tube may be cut. This works particularly well with a Mo tube substrate as it can be quickly removed by etching. The advantages of removing the substrate before cutting are a shortening of the laser cutting process and obtaining a more planar cut.

This resting annular body may be thinned to a preferred thickness. The major opposing surfaces of the die blank may be planarized and/or thinned to the desired surface finish by mechanical abrasion or by other means such as laser polishing, ion thinning, or other chemical methods. It is additionally contemplated that the blanks may be prepared by cutting the initially formed annular body by electro-discharge machining or other techniques known in the art.

When used for wire drawing, the outer periphery of the die 11 is mounted in a support so as to resist axially aligned forces due to wire drawing.

As shown in more detail in FIG. 1, the wire die 11 includes an opening 12 aligned along an axis in a direction normal to spaced apart parallel end surfaces or flat surfaces 13 and 15. For purposes of description, surface 13 is hereinafter referred as the top surface and surface 15 is referred to as the bottom surface 15. The opening 12 is of an appropriate size which is determined by the desired size of the wire. The straight bore section 17 of opening 12 includes has a circular cross section which is determinative of the desired final diameter of the wire to be drawn. From the straight bore section 17, the opening 12 tapers outwardly at exit taper 19 toward the top surface 13 and at entrance taper 21 toward the bottom surface 15. The wire to be drawn initially passes through entrance taper 21 where an initial size reduction occurs prior to passing through the straight bore section 17 and exit taper 19.

The entrance taper 21 extends for a greater distance along the axial direction than exit taper 19. Thus, the straight bore section 17 is closer to top surface 13 than to bottom surface 15. Entrance taper 21 includes a wide taper 25 opening onto the bottom surface 15 and narrow taper 23 extending between the straight bore 17 and the wider taper 25.

Upon removal of the substrate, the central opening formed typically serves as pilot hole so that the opening may be shaped and sized by techniques known in the art. The opening 12 may be suitably shaped and sized by utilizing a pin ultrasonically vibrated in conjunction with diamond grit slurry to abrade an opening 12 by techniques known in the art.

Preferably, wire dies have a thickness of about 0.3–10 millimeters. The diameter measurement as in the case of a rounded shape, is preferably about 0.5–20 millimeters. Preferred thicknesses are from 0.3–10 is millimeters, preferably 1–5 millimeters. The opening or hole 12 suitable for drawing wire typically has a diameter from 0.030 mm to 5.0 mm. Desirable the cylindrically or tubular substrate utilized to form the central opening has a diameter less than the desired final diameter of the wire die. Wire dies as prepared above, may be used to draw wire having desirable uniform properties.

A preferred technique for forming the diamond wire die substrate of the present invention is set forth in U.S. Pat. No. 5,110,579 to Anthony et al. According to the processes set forth in the patent, diamond is grown by chemical vapor deposition on a substrate such as molybdenum by a filament process. According to this process, an appropriate mixture such as set forth in the example is passed over a filament for an appropriate length of time to build up the substrate to a desired thickness and create a diamond film. As set forth in the patent, a preferred diamond layer has substantially transparent columns of diamond crystals having a <110> orientation perpendicular to the substrate. Grain boundaries between adjacent diamond crystals having hydrogen atoms saturating dangling carbon bonds is preferred wherein at least 50 percent of the carbon atoms are believed to be tetrahedral bonded based on Raman spectroscopy, infrared and X-ray analysis. It is also contemplated that H, F, Cl, O or other atoms may saturate dangling carbon atoms.

Figure 3:
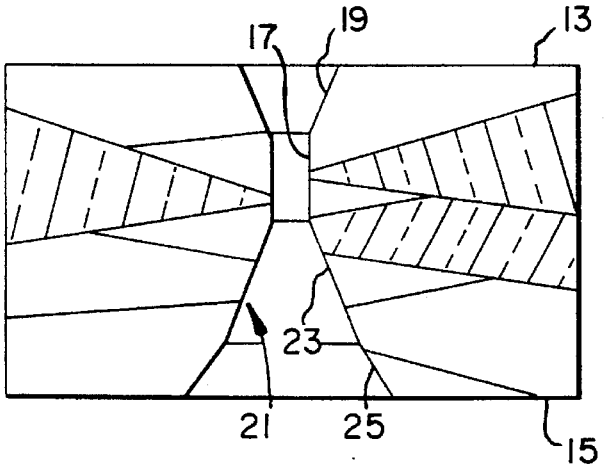
FIG. 3 is a cross-sectional view of the wire die portion shown in FIG. 2.

The view as illustrated in FIG. 3 of the polycrystalline diamond film in cross section further illustrates the substantially transparent columns of diamond crystals having a <110> orientation perpendicular to the cylindrical growth substrate. The preferred annular body utilized in the present invention has the properties described above including, grain boundaries between adjacent diamond crystals preferably have hydrogen atoms saturating dangling carbon bonds as illustrated in the patent.

When utilized in the present invention, the resulting annular body has an interior surface 17 corresponding to the initial growth surface that was adjacent the molybdenum substrate during growth of the diamond film and exterior surface 11 which is the surface exposed to the chemical vapor deposition process. This positioning of the wire die results in a columnar microstructure as illustrated in FIG. 3. The initial vapor deposition of diamond on the substrate results in the seeding of diamond grains or individual diamond crystals. As shown in FIG. 3, as the individual crystals growth in a radial direction, i.e. a direction normal or perpendicular to the axis of the cylindrical substrate. FIG. 3 shows the cross sectional area as measured along planes parallel to the top and bottom surfaces.

The annular bodies have a diamond grain size distribution gradient along their wall thickness where grain sizes are small near the inner diameter and increase in size along the wall thickness with increasing distance from the inner diameter. The preferred growth pattern is a columnar growth in a radial direction from the inner diameter.

The preferred annular body has a uniform inner diameter with substantially uniform wall thicknesses and grain boundaries which extend radically from the inner diameter due to columnar growth. More grain boundaries appear near the inner diameter of these diamond tubes than near the outer circumference, which is consistent with larger grain size diamond being formed near the outer circumference. The diameter of the tubes is also desirably substantially uniform.

The initial vapor deposition of diamond on the substrate results in the seeding of diamond grains or individual diamond crystals. As shown in FIG. 3, as the individual crystals growth in a radial direction, i.e. a direction normal to the opening.

In accordance with the preferred embodiment of the present invention, the straight bore section 17 is preferably substantially entirely within a plurality of diamond grains. As illustrated in FIG. 3, the interior wall or surface of the straight bore 17 intersects and is positioned interior to a plurality of diamond grains illustrated at 27. The <110> preferred grain direction is preferably perpendicular to the major plane of the film and a randomly aligned grain direction about the <110>.

A preferred process for making the film is the filament process as above described. Additional preferred properties of the diamond film include a thermal conductivity greater than about 4 watts/cm-K. The film is preferably non-opaque or transparent or translucent and contains hydrogen and oxygen greater than about 1 part per million. The diamond film preferably contains less than one part per million of catalyst material, such as iron, nickel, or cobalt. The film may contain greater than 10 parts per billion and less than 10 parts per million of Si, Ge, Nb, V, Ta, Mo, W, Ti, Zr or Hf. Preferably the film may also contain more than one part per million of a halogen, i.e. fluorine, chlorine, Bromine, or iodine. Additional additives may include N, B, O, and P which may be present in the form of intentional additives. It's anticipated that films that can be utilized in the present invention may be made by other processes, such as by microwave diamond forming processes.

It is contemplated that CVD diamond having such preferred conductivity may be produced by other techniques such as microwave CVD and DC jet CVD. Although, preferably the resulting CVD diamond film may has N, S, Ge, Al, and P, each at levels less than 100 ppm, it is contemplated that suitable films may be produced at greater levels.

We claim:

1. An annular body comprising a transparent CVD diamond body having an opening of uniform diameter, the opening establishing an interior surface in the annular body and with said interior surface in a region of smaller diamond grains and an external surface defined by a periphery of the annular body and having a region of larger diamond grains, wherein said opening extends entirely through said body along an axial direction, said body including diamond grains having a, 110 orientation extending substantially radially to the axial direction so that the grains do not extend parallel to one another.

2. An annular body in accordance with claim 1 wherein said interior surface corresponds to an initial diamond growth surface.

3. An annular body in accordance with claim 1 for drawing wire wherein said opening comprises a wire bearing portion of substantially circular cross-section determinative of the diameter of the wire being positioned in said region of smaller and said wire bearing portion comprises a straight bore section having a circular cross section.

4. An annular body in accordance with claim 3 wherein said opening tapers outwardly in one direction from said straight bore section toward said first surface and tapers outwardly in the opposite direction toward said second surface.

5. An annular body in accordance with claim 4 wherein said outward taper in said one direction forms a exit taper for the wire and said outward taper in the other direction toward said second surface forms an entrance taper.

6. An annular body in accordance with claim 5 wherein said entrance taper extends for a greater distance along the axial direction than exit taper.

7. An annular body in accordance with claim 4 wherein said body has a thickness as measured along the axial direction of about 0.3–10 millimeters.

8. An annular body in accordance with claim 4 wherein said diamond is grown by chemical vapor deposition on a substrate by a filament process, Selected from the group consisting of Si, C (graphite), Ge, Mo, Nb, V, Ta, W, Ti, Zr or Hf or alloys thereof.

9. An annular body in accordance with claim 4 wherein said diamond comprises a film of substantially transparent columns of diamond crystals having a <110> orientation normal to the axial direction.

10. An annular body in accordance with claim 4 wherein said diamond said opposing surfaces have been planarized by mechanical lapping and/or chemical, laser, or ion finishing to the desired surface finish.

11. An annular body in accordance with claim 1 wherein said diamond body comprises a plurality of diamond grains and said opening has a wire bearing portion substantially within a plurality of diamond grains.

12. An annular body in accordance with claim 11 wherein said interior surface corresponds to an initial diamond growth surface.

13. An annular body in accordance with claim 12 wherein said wire bearing portion comprises a straight bore section having a circular cross section.

14. An annular body in accordance with claim 13 wherein said opening tapers outwardly in one direction from said straight bore section toward said first surface and tapers outwardly in the opposite direction toward said second surface.

15. An annular body in accordance with claim 14 wherein said outward taper in said one direction forms an exit taper for the wire and said outward taper in the other direction toward said second surface forms an entrance taper.

16. An annular body in accordance with claim 1 wherein process for making the film is made by passing a mixture of gases over a filament for an appropriate length of time to build up the thickness of said substrate to a desired thickness.

17. An annular body in accordance with claim 1 wherein said body has a thermal conductivity greater than about 4 watts/cm-K.

18. An annular body in accordance with claim 1 wherein said body is non-opaque and contains hydrogen and oxygen greater than about 1 part per million.

19. An annular body in accordance with claim 1 wherein said body preferably contains less than one part per million of catalyst material, such as iron, nickel, or cobalt.

20. An annular body in accordance with claim 1 wherein said body contains greater than 10 parts per billion and less than 10 parts per million of Nb, V, Ta, Mo, W, Ti, Zr or Hf.

21. An annular body in accordance with claim 1 wherein said body comprises more than one part per million of a halogen, i.e. fluorine, chlorine, bromine, or iodine.

22. An annular body in accordance with claim 1 which has a single centrally positioned opening.

23. An annular body in accordance with claim 1 wherein the diamond body or any part thereof is mounted in or attached to a fixture which is suitable for the support of the die.

24. An annular body in accordance with claim 1 wherein the diamond has an electrical resistivity less than 1000 ohms per centimeter at room temperature.

25. An annular body in accordance with claim 1 wherein the diamond has an electrical resistivity greater than 1,000,000 ohms per centimeter at room temperature.

26. An annular body in accordance with claim 1 which has no voids greater than 10 microns in diameter, or inclusions of another material or carbon phase.

27. An annular body in accordance with claim 1 which has a thermal conductivity of more than 4 watts per centimeter-Kelvin.

28. An annular body in accordance with claim 1 formed from a diamond layer deposited by microwave, plasma, flame or dc jet process.

29. An annular body in accordance with claim 1 having saturated dangling carbon atoms.

* * * * *